US011791582B2

(12) United States Patent
Svencickij et al.

(10) Patent No.: US 11,791,582 B2
(45) Date of Patent: Oct. 17, 2023

(54) PLUG CONTACT

(71) Applicant: Lumberg Connect GmbH, Schalksmeuh (DE)

(72) Inventors: Oleg Svencickij, Neuenrade (DE); Paulo Russo, Dortmund (DE); Dirk Pfaffenbach, Halver (DE)

(73) Assignee: LUMBERG CONNECT GMBH, Schalksmuehle (DE)

( * ) Notice: Subject to any disclaimer, the term of this patent is extended or adjusted under 35 U.S.C. 154(b) by 8 days.

(21) Appl. No.: 17/716,287

(22) Filed: Apr. 8, 2022

(65) Prior Publication Data

US 2022/0360010 A1 Nov. 10, 2022

(30) Foreign Application Priority Data

May 7, 2021 (DE) ..... 102021111935.9

(51) Int. Cl.
*H01R 11/20* (2006.01)
*H01R 13/24* (2006.01)
*H01R 43/01* (2006.01)

(52) U.S. Cl.
CPC ..... *H01R 13/245* (2013.01); *H01R 13/2457* (2013.01); *H01R 43/01* (2013.01)

(58) Field of Classification Search
CPC .. H01R 13/245; H01R 13/2457; H01R 43/01; H01R 4/2462
See application file for complete search history.

(56) References Cited

U.S. PATENT DOCUMENTS

| | | | | |
|---|---|---|---|---|
| 3,503,036 | A | 3/1970 | Desso | |
| 3,656,093 | A | 4/1972 | Kinkaid | |
| 4,681,385 | A * | 7/1987 | Kruger | H01R 24/76 439/186 |
| 6,554,659 | B2 | 4/2003 | Kikuchi et al. | |
| 6,716,073 | B1 * | 4/2004 | Lee | H01R 13/04 439/885 |
| 8,441,275 | B1 * | 5/2013 | Alladio | G01R 1/0466 439/91 |
| 10,530,085 | B2 | 1/2020 | Mitsui | |
| 2006/0121798 | A1 | 6/2006 | Lappohn | |

(Continued)

FOREIGN PATENT DOCUMENTS

| | | | |
|---|---|---|---|
| CN | 1156945 | C | 7/2004 |
| DE | 4330390 | A1 | 3/1995 |
| DE | 102004052712 | A1 | 5/2006 |

(Continued)

*Primary Examiner* — Phuong Chi Thi Nguyen
(74) *Attorney, Agent, or Firm* — Von Rohrscheidt Patents

(57) ABSTRACT

A plug contact stamped from a strip of sheet metal, the plug contact including cut edges and rolled sides; a clamping section configured to fix the plug contact in a contact carrier; a contact fork formed by two spring elastic contact arms forming a receiving cavity between each other and including cut edges that are oriented towards each other, wherein a first end of the two spring elastic contact arms respectively originates from the clamping section and a second end of the two spring elastic contact arms respectively forms a contact bud, wherein the two spring elastic contact arms include rolled sides that are oriented towards each other and produced by forming the second end of the spring elastic contact arms respectively.

11 Claims, 5 Drawing Sheets

(56) References Cited

U.S. PATENT DOCUMENTS

2011/0159709 A1* 6/2011 Polnyi ..... H01R 12/57
439/65

FOREIGN PATENT DOCUMENTS

| | | | |
|---|---|---|---|
| DE | 202012004708 | U1 | 8/2013 |
| EP | 0144128 | | 6/1985 |
| JP | 201967574 | A | 4/2019 |

* cited by examiner

PLUG CONTACT

RELATED APPLICATIONS

This application claims priority from and incorporates by reference German Patent Application DE 10 2021 111 935.9 filed on May 7, 2021.

FIELD OF THE INVENTION

The invention relates to a plug contact stamped from a strip of sheet metal,

BACKGROUND OF THE INVENTION

Generic contacts are typically inserted in a large number adjacent to each other into contact carriers of a plug connector in order to produce a plug connector with a high contact density. Plug connectors of this type have the advantage that a plug insertion can connect a large number of feed contacts arranged at the plug connector with mating contacts, e.g. of a circuit board or another electronic component.

A contact of this generic type is shown e.g. in DE 43 30 390 A1.

Plug connectors have to comply with competing requirements with respect to the miniaturization, electrical safety and ability to transfer high currents. Reducing the size of the plug connectors causes a reduction of distances between the individual contacts which reduces insulation distances. The contacts themselves become narrower which reduces conductor cross sections and which limits an ability to conduct high currents. When reducing the size of the contacts, electrical currents and voltages still have to be transferred reliably to the mating contacts. Contacting mating contacts requires certain contact pressures which are among other things dependent upon an elasticity module of the contact material and its material thickness. In particular in plug connectors according to the RAST standard there is a recent trend to substitute plug connectors with the next smaller plug connectors without reducing requirements regarding contact reliability and transmission capacity.

BRIEF SUMMARY OF THE INVENTION

Thus, it is an object of the invention to provide a plug connector that fulfills requirements for reducing the plug connector size.

The object is achieved by a plug contact stamped from a strip of sheet metal, the plug contact comprising: cut edges and rolled sides; a clamping section configured to fix the plug contact in a contact carrier; a contact fork formed by two spring elastic contact arms forming a receiving cavity between each other and including cut edges that are oriented towards each other, wherein a first end of the two spring elastic contact arms respectively originates from the clamping section and a second end of the two spring elastic contact arms respectively forms a contact bud, wherein the two spring elastic contact arms include rolled sides that are oriented towards each other and produced by forming the second end of the spring elastic contact arms respectively, wherein the rolled sides of the clamping section and of the two spring elastic contact arms that are oriented parallel to each other are arranged in a common plane; a stop formed by a cut edge of the clamping section and oriented towards the receiving cavity, a separation line centrally arranged between the contact buds that divides the receiving cavity vertically in a direction of the clamping section, and wherein the clamping section includes a relief cut in an origin portion of the two spring elastic contact arms, so that the stop protrudes into the receiving cavity in a direction towards the contact buds.

The characterizing features facilitate reducing an overall length of the contact while maintaining an effective length of the contact arm. Since the clamping section that supports the contact in the contact carrier requires a particular minimum size in order to stabilize the comparatively long contact arms against transversal forces, reducing a length of the clamping section measured in the plug-in direction is not easily feasible.

The relief cut in the portion of the area of the origin of the respective contact arm, recesses a position of the contact arm origin in the clamping section relative to the stop of the clamping section. This facilitates keeping the effective contact arm length constant. At the same time, it is possible to recess the contact buds in the insertion direction with respect to the stop of the clamping section. While keeping the contact geometry otherwise constant spring properties of the contact arms of the contact are maintained.

According to the invention it is also possible to extend the effective contact arm while keeping the contact length constant by providing a relief cut but not recessing the contact arm accordingly.

The elasticity of the contact arm can be influenced particularly well, in particular increased when each contact arm includes a cut out in its origin area wherein the cut out reduces a contact arm width measured along the roll side and orthogonal to the separation line wherein fabrication is significantly simplified when the cut out of the clamping section transitions into the cut out of the respective contact arm and in particular both are segments of the same circle.

Reducing the contact arm width generates a higher elasticity of the contact arm in its origin portion when the relief cut of the clamping section transitions into the cut out of the respective contact arm as stated supra, e.g. when both segments are part of the same circle or of similar geometries, this has significant advantages for the stamping process to produce the contact according to the invention because a single tool can be employed.

Furthermore, the contact arms constrict the receiving cavity in a direction towards the contact buds.

Therefore, the contact arms run towards each other at a slant angle from their respective origin until they define a required width of a plug-in slot through the distance of the contact buds. Therefore, the contact is rather wide in the origin of the contact arms at the clamping section and narrower in the portion of the contact buds. Compared to contact arms that run in a straight line in the insertion direction this embodiment has the essential advantage that contact arms with a defined length in the insertion direction use up less installation space. Also this helps in turn to shorten the contacts and thus the plug connector or longer contact arms can be implemented with the contact length staying the same.

Another option to influence the elasticity of the contact arms and in particular to reduce or increase the elasticity in particular in portions is provided by each contact arm including an outer cut edge with an outer step contour between its origin and its contact bud and an inner cut edge with an inner step contour, in particular when the inner step contour and the outer step contour of each contact arm run asymmetrically relative to each other so that narrow and wide contact arm sections are created.

Particularly advantageously the contact arms and/or the clamping section are configured mirror symmetrical to the separation line.

In order to be able to apply defined contact forces and keep the elasticity of the contact arms in the portion of the contact buds as small as possible, the contact arms can respectively form a cam that protrudes in a direction towards the receiving cavity directly in front of the forming section that forms the contact buds.

The contact is furthermore characterized in that the cams of the contact arms are arranged proximal to the separation line and the origins of the contact arms are distal from the separation line, in particular when the contact arm width has a maximum in an area of the cams.

In order to provide defined reference surfaces when producing the contact by stamping, the clamping section includes a recess, in particular a circular hole.

The invention also relates to a plug connector including the plug contact according to one of the claims 1-11, wherein the contact carrier is provided in two pieces with a separation plane that is oriented transversal to the plug-in direction.

BRIEF DESCRIPTION OF THE DRAWINGS

Further advantages of the invention can be derived from the subsequent description of an embodiment with reference to drawing figures, wherein.

DETAILED DESCRIPTION OF THE INVENTION

Figure 1:
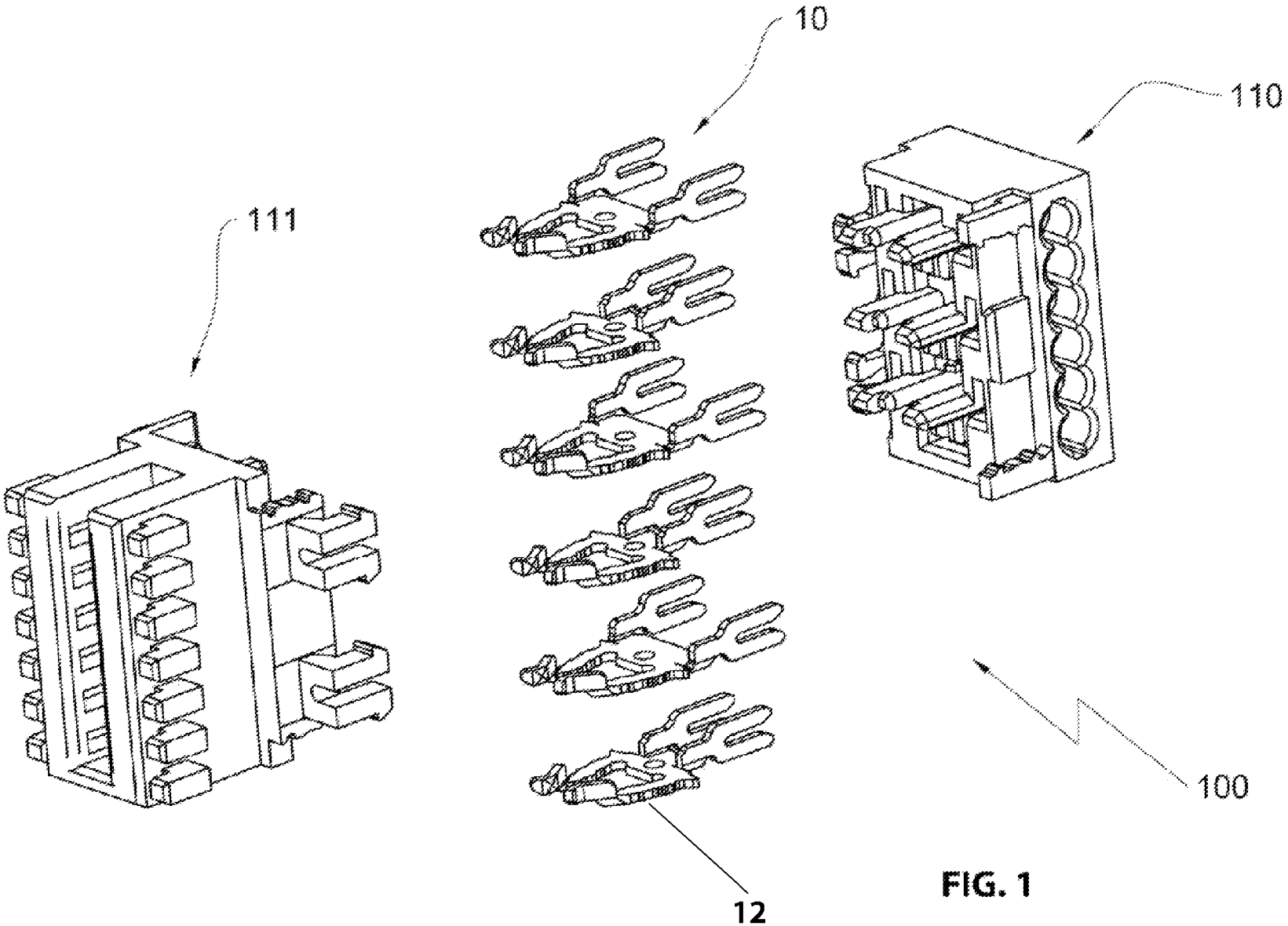
FIG. 1 illustrates an exploded view of a plug connector with contacts according to the invention in a first view.

The drawing figures show a contact according to the invention overall designated with reference numeral 10.

Figure 2:
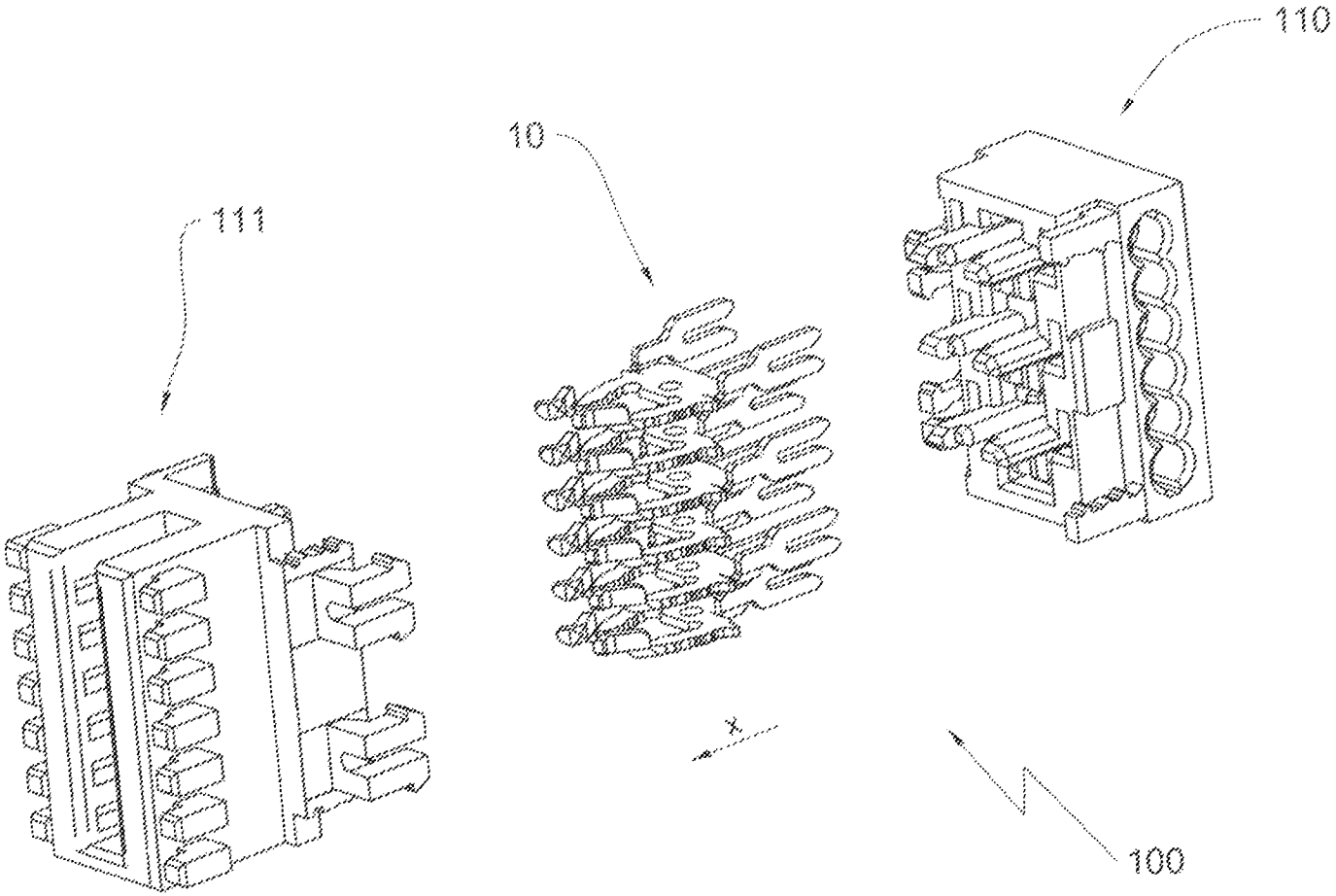
FIG. 2 illustrates a second exploded view of the plug contact according to FIG. 1.

The contact according to the invention is part of a plug connector 100 illustrated in FIGS. 1 and 2, wherein the plug connector includes a contact carrier base 110 and a contact carrier cover 111 and is thus formed by a two-piece contact carrier.

Plural contacts 10 according to the invention are arranged adjacent to one another in the contact carrier. Thus, the contacts are densely packed, c.f. FIG. 2, inserted into the contact carrier cover 111 and reliably retained therein by attaching the contact carrier base 110.

Figure 3:
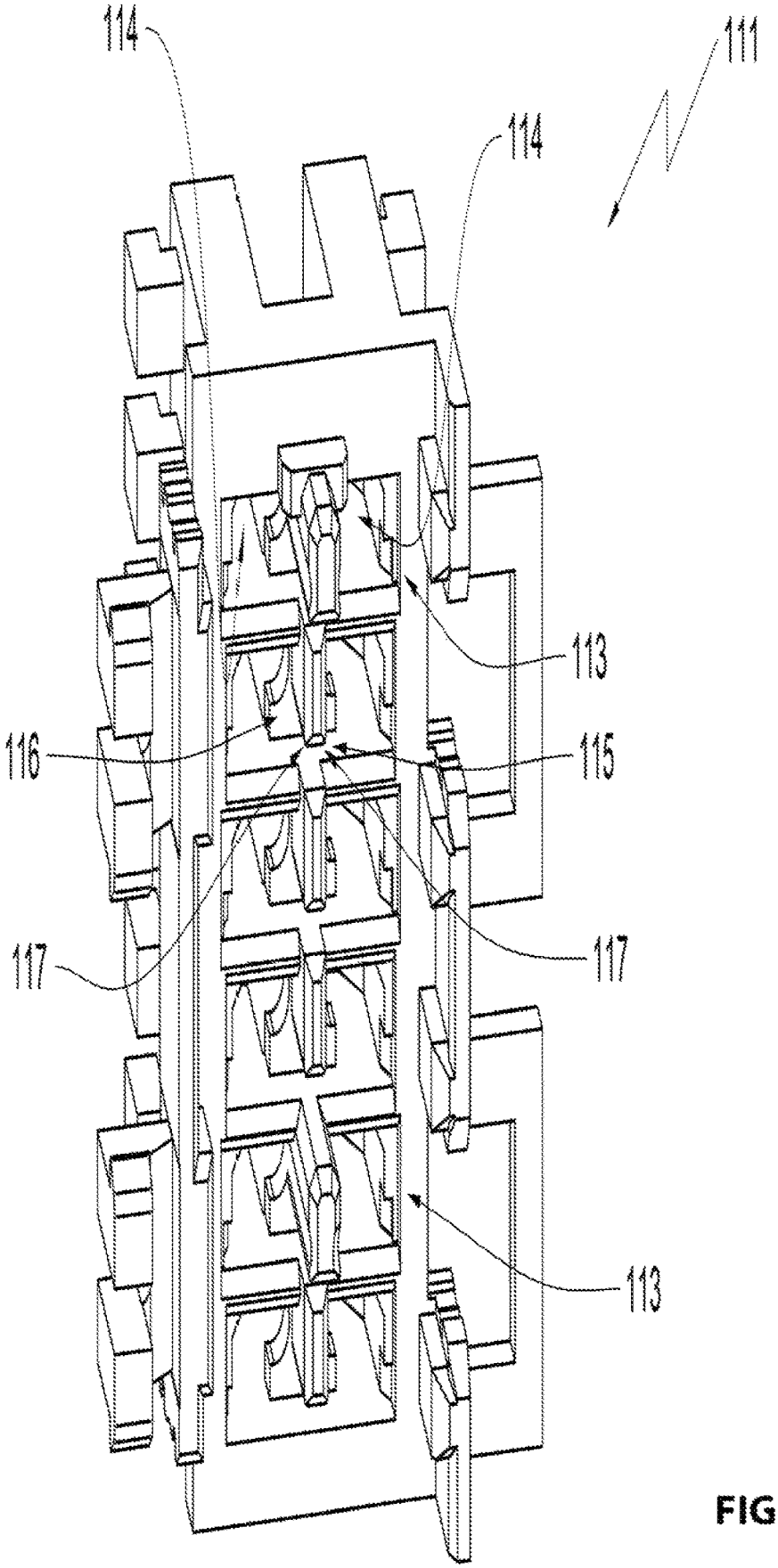
FIG. 3 illustrates a view of a contact carrier cover that is arranged in front in the plug-in direction.

The contact carrier cover that is illustrated in FIG. 3 and thus in a view of its back side oriented towards the contact carrier base 110 includes insertion openings 113 that form channels 114 arranged opposite to each other and configured to receive contact arms 11 and a clamping slot 115 for a clamping section 15 of the contact 10. The clamping slot 115 is defined in the insertion direction X of the contacts 10 by a retaining wall 116 and by lateral support bars 117.

Figure 4:
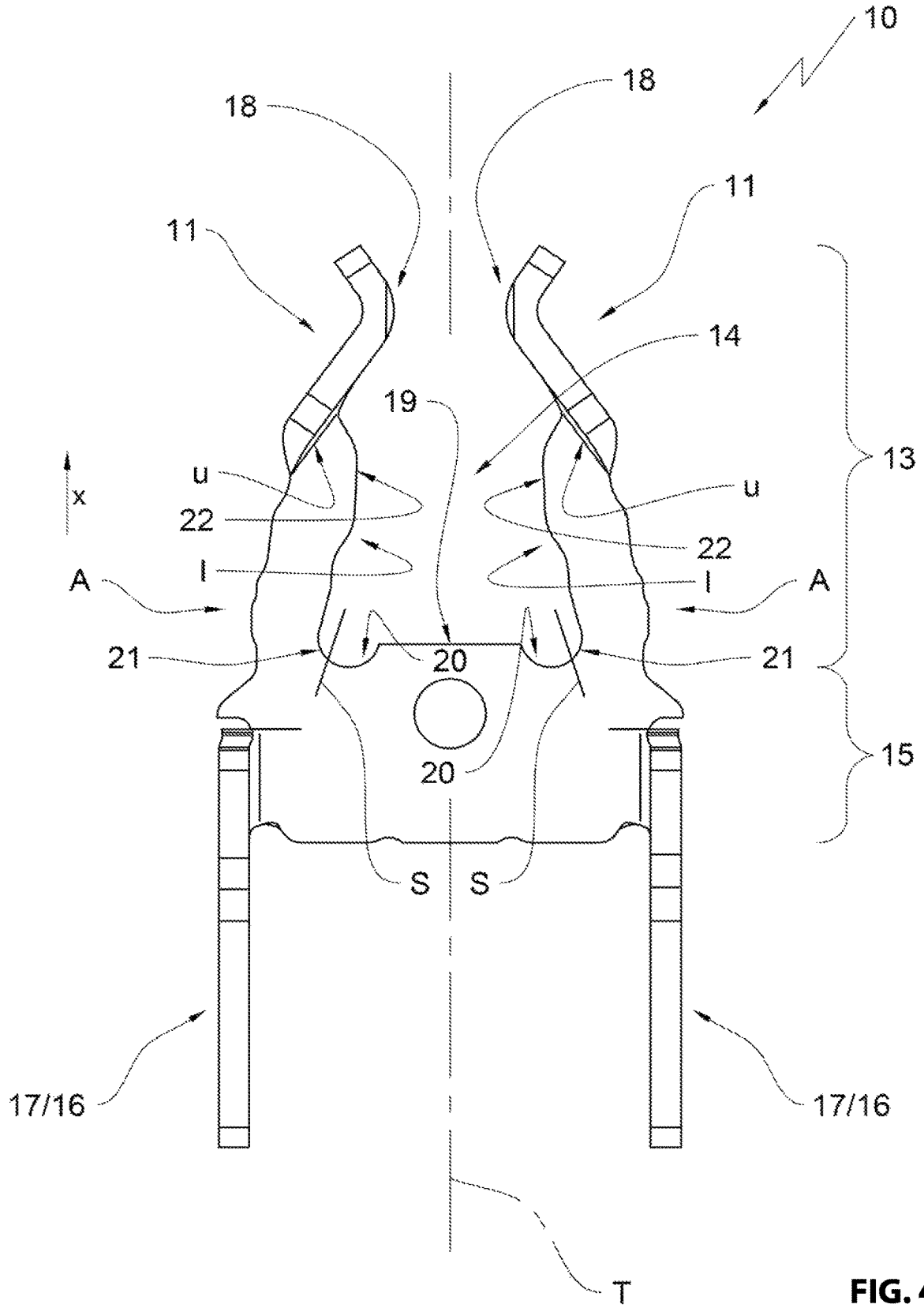
FIG. 4 illustrates the contact according to the invention in a front view.
Figure 5:
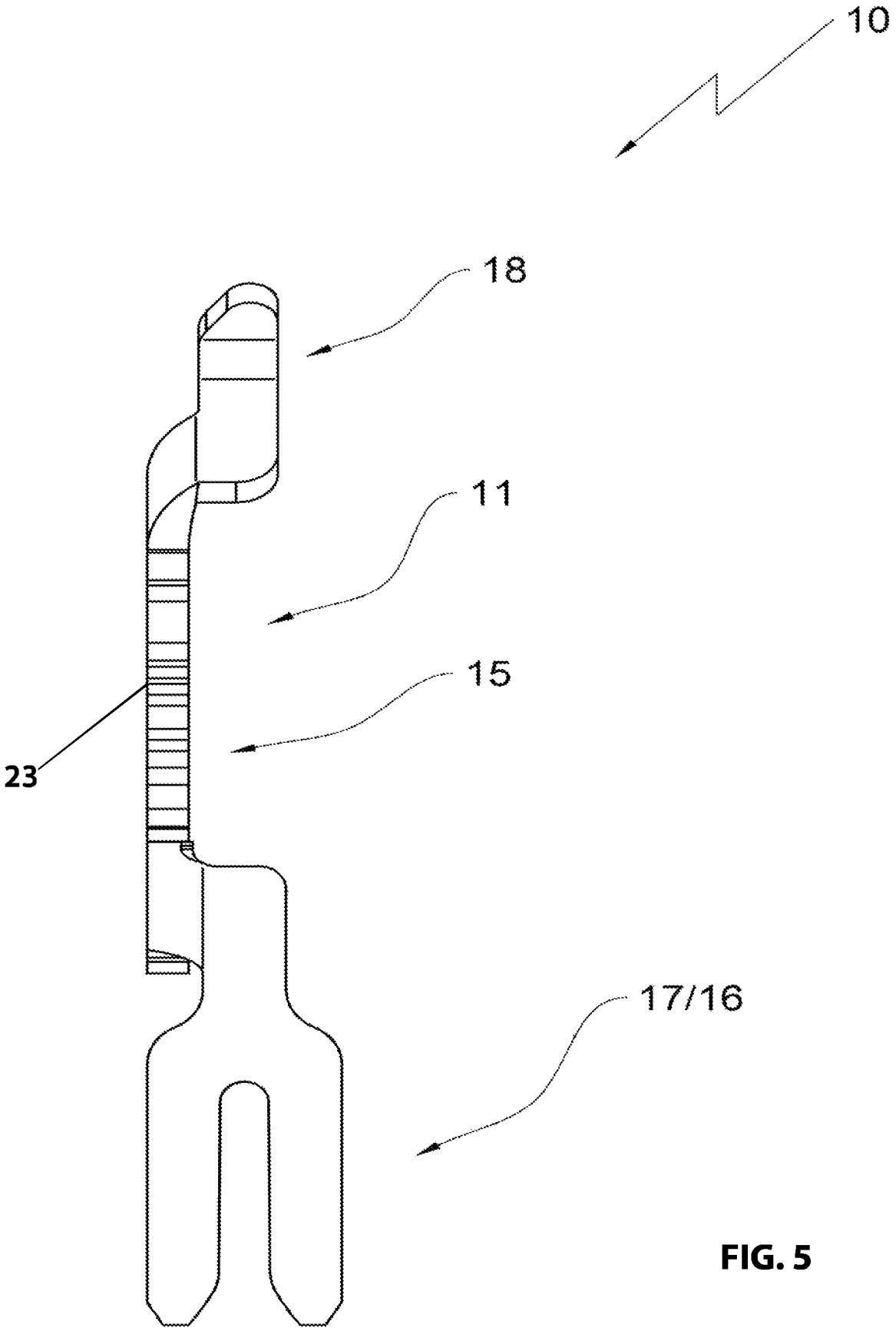
FIG. 5 illustrates the contact according to FIG. 4 in a side view.

FIGS. 4 and 5 show the contact 10 according to the invention for the plug connector 100 which includes a contact fork 13 arranged in front in an insertion direction X of the plug connector 100 and includes two contact arms 11. The contact arms 11 form a receiving space 14 between each other into which a non-illustrated opposite contact can penetrate. A clamping section 15 is arranged adjacent to the contact fork 13, wherein connection elements 16 configured to connect supply conductors originate from the clamping section 15 against the insertion direction X wherein the supply conductors are configured as clamping blades 17 in this embodiment.

The contact 10 is cut by a stamping and bending step from a strip of sheet metal so that it includes so called rolled sides 23 and cut edges 12. The rolled side corresponds to the sheet metal surface, the cut edges are formed by the stamping tool which cuts the contact out of the sheet metal strip. The cut edges run essentially at a right angle to the rolled sides.

The contact arms 11 form contact buds 18 downstream in the insertion direction X wherein the contact buds are formed by the rolled sides of the contact 10. Forming the contact arms 11 along a forming line U orients the rolled sides towards each other so that the rolled sides are oriented towards the separation line T that is centrally arranged between the contacts buds 18 and oriented perpendicular in a direction towards the clamping section 15.

The clamping section 15 forms a stop 19 which is arranged in front in the insertion direction X and protrudes into the receiving cavity 14 and is formed by an accordingly configured cut edge of the clamping section 15. This stop 19 limits the insertion travel of the contact 10 into the contact carrier 111 in cooperation with the retaining wall 116 of the contact carrier cover 111, c.f. FIG. 3.

The rolled sides of the clamping section 15 are supported in the contact carrier cover 11 at the supports bars 117 in order to prevent a lateral tilting of the contact 10 in the contact carrier.

The contact arms 11 originate from the clamping section 15. The clamping section 15 includes a relief cut 20 in an origin portion of the contact arms 11 so that the stop 19 protrudes into the receiving cavity 14.

The respective contact arm 11 itself is provided with a cut out 21. This cut out 21 reduces a contact arm width measured orthogonal to the separation line T. The respective relief cut 20 of the clamping section 15 and the respective cut out of the contact arm 11 are formed by a common circle. FIG. 4 illustrates a separation line S to emphasize the separation of the relief cut 20 and the cut out 21 in an exemplary manner and not to scale.

The respective relief cut 20 in the origin portion of the contact arms 11 in the clamping section 15 increases an effective length of the contact arm which is essential in particular with respect to elasticity of the contact arm in the origin portion. Additionally, elasticity of the contact arm 11 is increased in its origin by the respective cut out 21 and the material removal associated therewith.

As recited supra the relief cut 20 provides more options with respect to contact configuration. The contact arm 11 can be shortened when required which can facilitate a shorter overall configuration of the plug connector 100. However, it is also possible to increase elasticity of the contact arm 11 simply by making the relief cut 20 longer.

Independently from the relief cut 20, the cut out 21 also provides options to increase elasticity of the respective contact arm 11.

Elasticity of the contact arms 11 is essential for contact forces applied in a portion of the contact buds 11 upon an opposite contact like a conductor circuit board or a contact blade. The contact forces are important with respect to electrical and mechanical properties and have to be generated in the right amount with the right progression which is determined by the configuration of the contact arm 11.

It is therefore proposed according to the invention to vary the contact arm width measured transversal to the separation line T along the contact arm length. Thus, each contact arm 11 includes a stepped outer contour A and a stepped inner contour I. The contours A and I can theoretically be configured symmetrical to one another, however, asymmetry between the contours A, I facilitates varying the contact arm width so that zones with greater elasticity and with less elasticity are created. Thus, the elasticity tensions in the contact arm 11 can be adapted in a defined manner to the contact forces required in the portion of the contact buds 18.

In the instant contact 10 a particularly stiff configuration of the contact arms is assured by forming cams 22 in a portion arranged directly adjacent to the contact buds 18 or the forming line U. Thus, the contact arm width reaches a maximum due to a protrusion of the separation line T and thus achieves particularly low elasticity values.

Overall, the invention provides solutions how the contact can be shortened with respect to a length measured in the insertion direction so that installation space is minimized by moving the contact arm origin back at the clamping section 15. Additionally, the invention presents options how to influence shortened contact arms 11 with respect to their elasticity.

The contact arm width increased by the cam, additionally facilitates a safe engagement of a bending tool, which produces the contact buds 18 by bending the stamped component by approximately by 90 degrees along the forming line U.

The configuration of the contact buds 18 provides another essential advantage of the contact 10 according to the invention. The contact buds 18 contact on the rolled sides due to the forming, whereas the contact arms are oriented towards the opposite contact with their cut edges. Thus, stamping strips can be used that are finished on the rolled sides so that the finishing of the rolled sides after forming produces the surface of the contact bud 18. Complex finishing of the contacts 10 can thus be omitted.

REFERENCE NUMERALS AND DESIGNATIONS

10 plug contact
11 contact arm
13 contact fork
13 cut edge
14 receiving cavity
15 clamping section
16 connection element
17 clamping blade
18 contact bud
19 stop
20 relief cut
21 cut out
22 cam
23 rolled side
100 plug connector
110 contact carrier base
111 contact carrier cover
113 insertion opening
114 channel
115 clamping slot
116 retaining wall
117 support bar
A outer contour
I inner contour
S dividing line
T separation line
U forming line
X insertion direction

What is claimed is:

1. A plug contact stamped from a strip of sheet metal, the plug contact comprising:

cut edges and rolled sides;

a clamping section configured to fix the plug contact in a contact carrier;

a contact fork formed by two spring elastic contact arms forming a receiving cavity between each other and including cut edges that are oriented towards each other, wherein a first end of the two spring elastic contact arms respectively originates from the clamping section and a second end of the two spring elastic contact arms respectively forms a contact bud, wherein the two spring elastic contact arms include rolled sides that are oriented towards each other and produced by forming the second end of the spring elastic contact arms respectively, wherein the rolled sides of the clamping section and of the two spring elastic contact arms that are oriented parallel to each other are arranged in a common plane;

a stop formed by a cut edge of the clamping section and oriented towards the receiving cavity, a separation line centrally arranged between the contact buds that divides the receiving cavity vertically in a direction of the clamping section, and wherein the clamping section includes a relief cut in an origin portion of the two spring elastic contact arms, so that the stop protrudes into the receiving cavity in a direction towards the contact buds;

wherein each contact arm of the two spring elastic contact arms includes a cut out in an origin portion of the contact arm, and wherein the cut out reduces a contact arm width measured along the rolled side and orthogonal to the separation line.

2. The plug contact according to claim 1, wherein a relief cut of the clamping section transitions into the cut out of the contact arm so that the relief cut and the cut out are segments of one identical circle.

3. The plug contact according to claim 1, wherein the two spring elastic contact arms or the clamping section are configured mirror symmetrical to the separation line.

4. The plug contact according to claim 1, wherein the clamping section includes a recess configured as a circular hole.

5. The plug contact according to claim 1, wherein the two spring elastic contact arms constrict the receiving cavity in a direction towards the contact buds.

6. The plug contact according to claim 5, wherein each of the two spring elastic contact arms includes an outer cut edge with an outer step contour and an inner cut edge with an inner step contour between an origin of each of the two spring elastic contact arms and the contact buds.

7. The plug contact according to claim 6, wherein the inner step contour and the outer step contour of each of the two spring elastic contact arms are asymmetrical to each other so that narrow and wide contact arm sections are created.

8. The plug contact according to claim 6, wherein the two spring elastic contact arms respectively form a cam directly adjacent to a section that forms the contact buds, and wherein the cam respectively protrudes in a direction towards the receiving cavity.

9. The plug contact according to claim 8, wherein the cam is respectively arranged proximal to the separation line and the origins of the cam are respectively arranged distal from the separation line.

10. The plug contact according to claim 8, wherein a contact arm width forms a maximum in a portion of the cams.

11. A plug connector, comprising:

a plug contact stamped from a strip of sheet metal, the plug contact comprising:

cut edges and rolled sides;

a clamping section configured to fix the plug contact in a contact carrier;

a contact fork formed by two spring elastic contact arms forming a receiving cavity between each other and including cut edges that are oriented towards each other, wherein a first end of the two spring elastic contact arms respectively originates from the clamping section and a second end of the two spring elastic contact arms respectively forms a contact bud, wherein the two spring elastic contact arms include rolled sides that are oriented towards each other and produced by forming the second end of the spring elastic contact arms respectively, wherein the rolled sides of the clamping section and of the two spring elastic contact arms that are oriented parallel to each other are arranged in a common plane;

a stop formed by a cut edge of the clamping section and oriented towards the receiving cavity, a separation line centrally arranged between the contact buds that divides the receiving cavity vertically in a direction of the clamping section, and wherein the clamping section includes a relief cut in an origin portion of the two spring elastic contact arms, so that the stop protrudes into the receiving cavity in a direction towards the contact buds;

wherein each contact arm of the two spring elastic contact arms includes a cut out in an origin portion of the contact arm, and wherein the cut out reduces a contact arm width measured along the rolled side and orthogonal to the separation line;

wherein the contact carrier is provided in two components and includes a separation plane that is oriented transversal to a plug-in direction.

* * * * *